US006190534B1

(12) United States Patent
Bogdan

(10) Patent No.: US 6,190,534 B1
(45) Date of Patent: Feb. 20, 2001

(54) NAPHTHA UPGRADING BY COMBINED OLEFIN FORMING AND AROMATIZATION

(75) Inventor: Paula L. Bogdan, Mount Prospect, IL (US)

(73) Assignee: UOP LLC, Des Plaines, IL (US)

( * ) Notice: Under 35 U.S.C. 154(b), the term of this patent shall be extended for 0 days.

(21) Appl. No.: 09/268,400

(22) Filed: Mar. 15, 1999

(51) Int. Cl.[7] ..... C10G 35/06
(52) U.S. Cl. ..... 208/65; 208/64; 208/79
(58) Field of Search ..... 208/65, 64, 79

(56) References Cited

U.S. PATENT DOCUMENTS

| | | | | |
|---|---|---|---|---|
| 4,645,586 | | 2/1987 | Buss | 208/65 |
| 4,663,020 | * | 5/1987 | Fleming | 208/65 |
| 4,737,262 | * | 4/1988 | Frank et al. | 208/65 |
| 4,929,333 | | 5/1990 | Moser et al. | 208/65 |
| 5,037,529 | | 8/1991 | Dessau et al. | 208/64 |

* cited by examiner

*Primary Examiner*—Helane E. Myers
(74) *Attorney, Agent, or Firm*—John G. Tolomei; John F. Spears, Jr.

(57) ABSTRACT

A process combination is disclosed to selectively upgrade naphtha to obtain a component for blending into gasoline. A naphtha feedstock is subjected to formation of olefins from paraffins using a nonacidic catalyst followed by aromatization of the resulting olefin-containing product to obtain improved yields of an aromatics-rich, high-octane gasoline product.

16 Claims, 2 Drawing Sheets

NAPHTHA UPGRADING BY COMBINED OLEFIN FORMING AND AROMATIZATION

BACKGROUND OF THE INVENTION

1. Field of the Invention

This invention relates to an improved process combination for the conversion of hydrocarbons, and more specifically for the selective upgrading of naphtha by a combination of selective olefin formation and aromatization.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, increased alkylation of paraffins and olefins, isomerization of butanes and light naphtha and the use of oxygenated compounds.

Catalytic reforming is a major focus, as this process generally supplies 30–40% or more of the gasoline pool. Increased reforming severity to obtain higher-octane reformate generally results in higher production of fuel-value light gases and a lower yield of the desired $C_5$+ reformate. Since this yield effect is magnified at higher reforming severity, workers in the art are faced with an increasingly difficult task of improving reforming catalysts and processes in order to maintain the yield of gasoline-range product.

One focus has been on the relative importance and sequence of the principal reforming reactions, e.g., dehydrogenation of naphthenes to aromatics, dehydrocyclization of paraffins to aromatics, isomerization of paraffins and naphthenes, hydrocracking of paraffins to light hydrocarbons, and formation of coke which is deposited on the catalyst. High yield of desired gasoline-range products are favored by the dehydrogenatlon, dehydrocyclization and isomerization reactions. The dual-function nature of reforming catalysts facilitates ready conversion of alkylcyclopentanes as well as cyclohexanes through isomerization in conjunction with dehydrogenation. Considering that reforming generally is effected in a series of zones containing catalyst, naphthene conversion to aromatics usually takes place principally in the first catalyst zones while paraffin dehydrocyclization and hydrocracking occurs primarily in subsequent catalyst zones.

The usual sequence of reforming reactions may be addressed advantageously through staging of catalysts containing different metals within a single reforming process unit. U.S. Pat. No. 4,929,333 (Moser et al.) teaches a germanium-containing reforming catalyst ahead of a germanium-free catalyst preferably containing rhenium and also cites other art appropriate to this concept.

Nonacidic zeolitic catalysts are known to be particularly effective for aromatization of paraffins through dehydrocyclization as well as for dehydrogenation of naphthenes. The staging of zeolitic catalysts for selected reactions also is recognized. U.S. Pat. No. 4,645,586 (Buss) teaches reforming using the sequence of a bifunctional catalyst having acid sites and containing a Group Vil metal followed by a nonacidic catalyst containing a large-pore zeolite (preferably L-zeolite) and a Group Vil metal. U.S. Pat. No. 5,037,529 (Dessau et al.) discloses dual-stage reforming the feed in the first stage with a nonacidic medium-pore zeolite containing a dehydrogenation/hydrogenation metal and Sn, In or TI, and converting first-stage effluent in the second stage with an acidic zeolite catalyst having a constraint index of 1–12.

SUMMARY OF THE INVENTION

It is an object of the present invention to provide an improved process combination to upgrade naphtha to gasoline. A specific object is to improve the yield of gasoline-range product from a reforming process.

This invention is based on the discovery that certain nonacidic, non-zeolitic catalysts effective for selective dehydrogenation may be combined with specified aromatization catalysts to obtain high yields of a high-octane aromatics-rich product.

A broad embodiment of the present invention is directed to the upgrading of a naphtha feedstock in a process combination comprising an olefin-forming zone containing a nonacidic, non-zeolitic catalyst comprising a platinum-group metal followed by an aromatization zone containing a catalyst comprising a platinum-group metal on a refractory inorganic oxide. Dehydrogenation is effected in the olefin-forming zone with minimal isomerization and hydrocracking, e.g., alkylcyclopentanes in the feedstock generally are not converted in this zone to a substantial extent. The olefin-forming catalyst preferably comprises a refractory inorganic oxide modified with an alkali metal; alternatively, the olefin-forming catalyst comprises a hydrotalcite. Optimally, selective olefin formation and aromatization are accomplished in the same hydrogen circuit. The process combination provides an improved yield of aromatics-rich product which usefully is blended into finished gasoline.

These as well as other objects and embodiments will become apparent from the detailed description of the invention.

DESCRIPTION OF THE PREFERRED EMBODIMENTS

Figure 1:
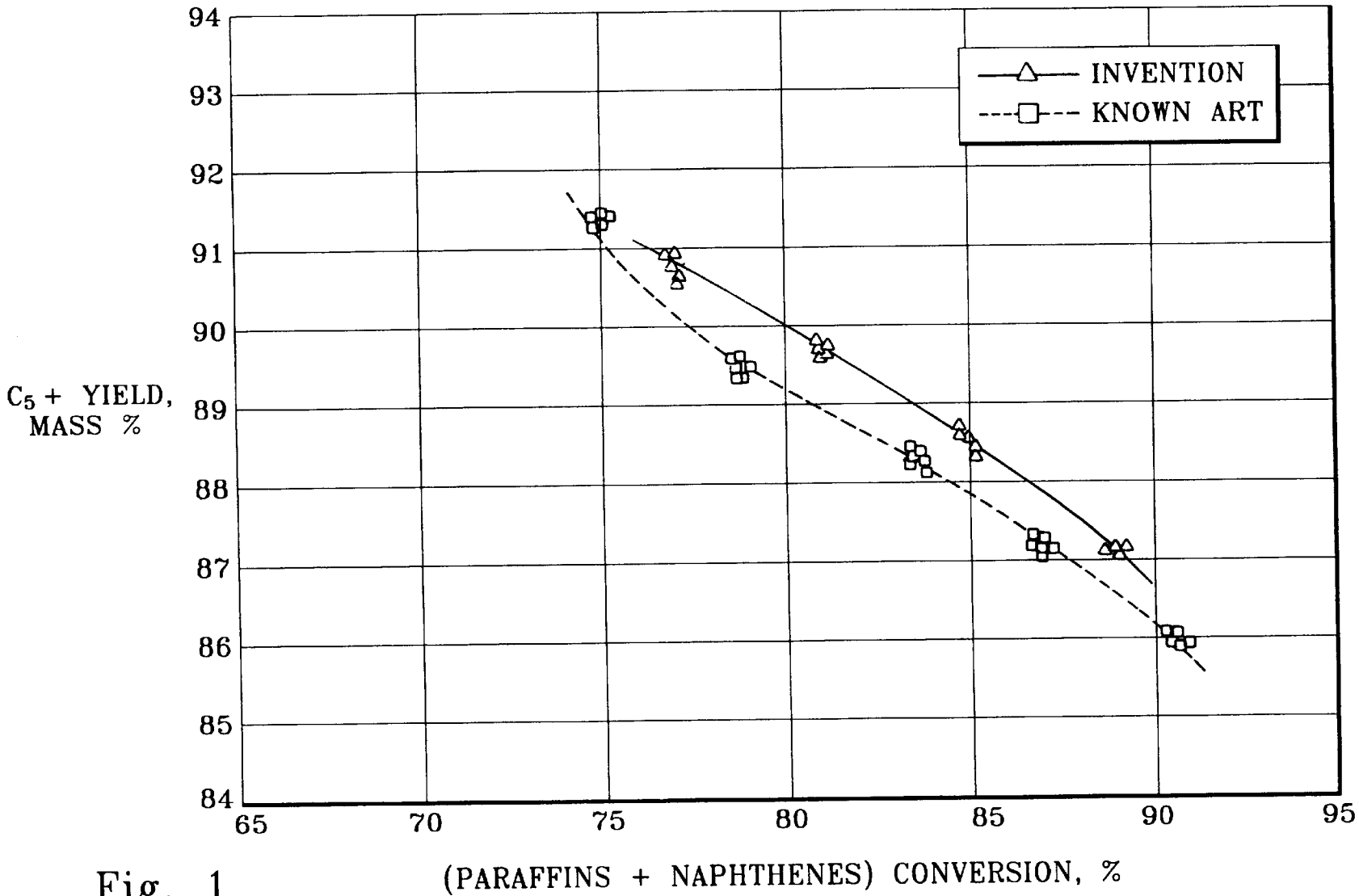
FIG. 1 shows the yield of $C_5$+ aromatics-rich product, as a function of (paraffins+naphthenes) conversion in naphtha feedstock, using the process combination of the invention in comparison to conventional reforming.

The olefin-forming step of the present invention is observed to be particularly useful in combination with aromatization, effecting improved yields of gasoline product and higher hydrogen purity. Within the spirit of the invention, a variety of nonacidic catalysts, process conditions and configurations are effective for the selective dehydrogenation of the feedstock. Such process combinations are suitably integrated into a petroleum refinery comprising crude-oil distillation, reforming, cracking and other processes known in the art to produce finished gasoline and other petroleum products.

The naphtha feedstock to the olefin-forming zone of the present combination comprises paraffins, naphthenes, and aromatics, and may comprise small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point typically from 0° to 100° C. and a 95%-distilled point of from about 160° to 230° C.; more usually, the initial boiling range is from about 40° to 80° C. and the 95%-distilled point from about 175° to 200° C.

The naphtha feedstock generally contains small amounts of sulfur and nitrogen compounds each amounting to less than 10 parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Inorganic Chemistry*, John Wiley & Sons (Fifth Edition, 1988)]. Optimally, the pretreating step will provide the present process with a hydrocarbon feedstock having low sulfur levels disclosed in the prior art as desirable, e.g., 1 ppm to 0.1 ppm (100 ppb). It is within the ambit of the present invention that this optional pretreating step be included in the present process combination.

Naphtha feedstock and free hydrogen comprise combined feed to the olefinforming zone, which contains a nonacidic olefin-forming catalyst and operates at suitable conditions to dehydrogenate paraffins without substantial formation of aromatics as would be expected in a conventional reforming process. The olefin-forming catalyst yields an olefin-containing intermediate stream which comprises olefins formed from paraffins and aromatics formed from cyclohexane and alkylcyclohexanes. Only a minor amount of isomerization, dehydrocyclization and hydrocracking takes place. The selective nature of the reaction is evidenced by the relatively low conversion of alkylcyclopentanes, which undergo isomerization and ring opening in conventional reforming, in this zone of the present invention; alkylcyclopentane conversion generally is less than about 50%, usually less than about 30%, and commonly less than about 20%. Olefins in the intermediate stream depend on equilibrium at reforming conditions and may amount to about 3 mass % or more, and often 5 mass % or more of the $C_5$+ hydrocarbons.

The olefin-forming catalyst comprises one or more platinum-group metals, selected from the group consisting of platinum, palladium, ruthenium, rhodium, osmium, and iridium, on a nonacidic support comprising one or more of a refractory inorganic-oxide and a large-pore molecular sieve. The catalyst is non-zeolitic, i.e., has the substantial absence of a zeolite component which would affect its olefin-formation selectivity. The "nonacidic support" has a substantial absence of acid sites, for example as an inherent property or through ion exchange with one or more basic cations. The nonacidity of the olefin-forming catalyst support may be determined using a variety of methods known in the art.

A preferred method of determining acidity is the heptene cracking test in which conversion of heptene, principally by cracking, aromatization and ring formation, is measured and compared at specified conditions. The test is carried out at an operational temperature of 425° C. on a hydrogen stream saturated with heptene, with an analysis performed using a gas chromatograph. Cracking is particularly indicative of the presence of strong acid sites. A nonacidic catalyst suitable for selective olefin formation demonstrates low conversion and particularly low cracking in the heptene test: conversion generally is less than 30% and cracking less than about 5%. The best supports demonstrate no more than about 5% conversion and negligible cracking.

Alternatively, nonacidity may be characterized by the ACAC (acetonylacetone) test. ACAC is converted over the support to be tested at specified conditions: dimethylfuran in the product is an indicator of acidity, while methylcyclopentenone indicates basicity. Conversion over the support of the invention during a 5-minute period at 150° C. at a rate of 100 cc/min should yield less than 5 mass %, and preferably less than 1%, acid products. Conversion to basic products can usefully be in the range of 0–70 mass %.

Another useful method of measuring acidity is $NH_3$-TPD (temperature-programmed desorption) as disclosed in U.S. Pat. No. 4,894,142, incorporated herein by reference; the $NH_3$-TPD acidity strength should be less than about 1.0. Other methods such as $^{31}P$ solids NMR of adsorbed TMP (trimethylphosphine) also may be used to measure acidity.

The preferred nonacidic support optimally comprises a porous, adsorptive, high-surface-area inorganic oxide having a surface area of about 25 to about 500 $m^2/g$. The porous support should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the present invention comprises alumina. Suitable alumina materials are the crystalline aluminas known as the theta-, alpha-, gamma-, and eta-alumina, with theta-, alpha-, and gamma-alumina giving best results. Magnesia, alone or in combination with alumina, comprises an alternative inorganic-oxide component of the catalyst and provides the required nonacidity. The preferred refractory inorganic oxide will have an apparent bulk density of about 0.3 to about 1.1 g/cc and surface area characteristics such that the average pore diameter is about 20 to 1000 angstroms, the pore volume is about 0.05 to about 1 cc/g, and the surface area is about 50 to about 500 $m^2/g$.

The inorganic-oxide powder may be formed into a suitable catalyst material according to any of the techniques known to those skilled in the catalyst-carrier-forming art. Spherical carrier particles may be formed, for example, from the preferred alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina support by known methods; (2) forming an extrudate from the powder by established methods and thereafter rolling the extrudate particles on a spinning disk until spherical particles are formed which can then be dried and calcined to form the desired particles of spherical support; and (3) wetting the powder with a suitable peptizing agent and thereafter rolling the particles of the powder into spherical masses of the desired size. The powder can also be formed in any other desired shape or type of support known to those skilled in the art such as rods, pills, pellets, tablets, granules, extrudates, and like forms by methods well known to the practitioners of the catalyst material forming art.

One form of carrier material for the olefin-forming catalyst is a cylindrical extrudate. The extrudate particle is optimally prepared by mixing the preferred alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

Preferred spherical particles may be formed directly by the oil-drop method as disclosed hereinbelow or from extrudates by rolling extrudate particles on a spinning disk. Manufacture of spheres by the well known continuous oil-drop method comprises: forming an alumina hydrosol containing the active components of the composite by any of the techniques taught in the art and preferably by reacting aluminum metal with hydrochloric acid; combining the resulting hydrosol with the catalyst carrier and a suitable gelling agent; and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging and drying treatments in oil and an ammoniacal solution to further improve their physical characteristics. The resulting aged and gelled particles are then washed and dried at a relatively low temperature of about 150° to about 205° C. and subjected to a calcination procedure at a temperature of about 450° to about 700° C. for a period of about 1 to about 20 hours. This treatment effects conversion of the alumina hydrogel to the corresponding crystalline gamma-alumina. U.S. Pat. No. 2,620,314 provides for additional details and is incorporated herein by reference thereto.

A catalyst support of the invention may incorporate other porous, adsorptive, high-surface-area materials. Within the scope of the present invention are refractory supports containing one or more of: (1) refractory inorganic oxides such as alumina, silica, titania, magnesia, zirconia, chromia, thoria, boria or mixtures thereof, (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$; and (5) combinations of materials from one or more of these groups.

It is essential that the catalyst be non-acidic, as acidity lowers the olefin-formation selectivity of the finished catalyst. The required nonacidity may be effected by any suitable method, including impregnation, co-impregnation with a platinum-group metal, or ion exchange. Impregnation of one or more of the alkali and alkaline earth metals, especially potassium, in a salt solution is favored as being an economically attractive method. The metal effectively is associated with an anion such as hydroxide, nitrate or a halide such as chloride or bromide consistent with nonacidity of the finished catalyst, with a nitrate being favored. Optimally, the support is cold-rolled with an excess of solution in a rotary evaporator in an amount sufficient to provide a nonacidic catalyst. The alkali or alkaline earth metal may be coimpregnated along with a platinum-group metal component, as long as the platinum-group metal does not precipitate in the presence of the salt of the alkali or alkaline earth metal.

Ion exchange is an alternative method of incorporating nonacidity into the catalyst. The inorganic-oxide support is contacted with a solution containing an excess of metal ions over the amount needed to effect nonacidity. Although any suitable method of contacting may be used, an effective method is to circulate a salt solution over the support in a fixed-bed loading tank. A water-soluble metal salt of an alkali or alkaline earth metal is used to provide the required metal ions; a potassium salt is particularly preferred. The support is contacted with the solution suitably at a temperature ranging from about 10° to about 100° C.

An alternative suitable support having inherent nonacidity may be termed a "synthetic hydrotalcite" characterized as a layered double hydroxide or metal-oxide solid solution. Hydrotalcite is a clay with the ideal unit cell formula of $Mg_6Al_2(OH)_{16}(CO_3)4H_2O$, and closely related analogs with variable magnesium/aluminum ratios may be readily prepared. W. T. Reichle has described in the *Journal of Catalysis*, 94, 547–557 (1985), the synthesis and catalytic use of such synthetic hydrotalcites, including materials having Mg and Al replaced by other metals. Calcination of such layered double hydroxides results in destruction of the layered structure and formation of materials which are effectively described as solid solutions of the resulting metal oxides.

These embodiments of the present support are disclosed in copending application Ser. No. 987,838, incorporated by reference, and are solid solutions of a divalent metal oxide and a trivalent metal oxide having the general formula $(M^{+2}{}_xO)(M^{+3}{}_yO)OH_y$ derived by calcination of synthetic hydrotalcite-like materials whose general formula may be expressed as $(M^2)_x(M^{+3})_y(OH)_zA_qrH20$. $M^{+2}$ is a divalent metal or combination of divalent metals selected from the group consisting of magnesium, calcium, barium, nickel, cobalt, iron, copper and zinc. $M^{+3}$ is a trivalent metal or combination of trivalent metals selected from the group consisting of aluminum, gallium, chromium, iron, and lanthanum. Both $M^{+2}$ and $M^{+3}$ may be mixtures of metals belonging to the respective class: for example, $M^{+2}$ may be pure nickel or may be both nickel and magnesium, or even nickel-magnesium-cobalt; $M^{+3}$ may be solely aluminum or a mixture of aluminum and chromium, or even a mixture of three trivalent metals such as aluminum, chromium, and gallium. $A_q$ is an anion, most usually carbonate although other anions may be employed equivalently, especially anions such as nitrate, sulfate, chloride, bromide, hydroxide, and chromate. The case where $M^{+2}$ is magnesium, $M^{+3}$ is aluminum, and A is carbonate corresponds to the hydrotalcite series.

It is preferable that the $(M^{+2}O)(M^{+3}{}_yO)OH_y$ solid solution has a surface area at least about 150 $m^2/g$, more preferably at least 200 $m^2/g$ and it is even more preferable that it be in the range from 300 to 350 $m^2/g$. The ratio x/y of the divalent and trivalent metals can vary between about 2 and about 20, with the ratios of 2 to about 10 being preferred.

Preparation of suitable basic metal-oxide supports is described in detail in the referenced copending application Ser. No. 987,838. Precursor gel is prepared at a temperature not exceeding about 10° C., and preferably is prepared in the temperature interval between about 0 and 5° C. In addition, the crystallization time is kept short, on the order of an hour or two at 65° C., to afford layered double hydroxides whose calcination leads to materials of unusual hydrothermal stability. Calcination of the layered double hydroxide is effected at temperatures between about 400 and about 750° C. Unusual stability and homogeneity is evidenced by the fact that spinel formation is not seen until calcination temperatures of about 800° C., whereas the spinel phase begins to appear in prior-art hydrotalcite-type layered double hydroxides at a calcination temperature of about 600° C.

In the above preferred embodiments of the olefin-forming catalyst composition comprising an inorganic-oxide support, the catalyst favorably is substantially free of microcrystalline porous material, i.e., a molecular sieve, and in particular is substantially zeolite-free.

An essential ingredient of the olefin-forming catalyst is the platinum-group metal component, comprising one or more of a platinum, palladium, rhodium, ruthenium, iridium or osmium component with a platinum component being preferred. This metal component rilay exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The platinum-group metal component generally comprises from about 0.05 to 5 mass % of the catalytic composite, preferably 0.05 to 2 mass %, calculated on an elemental basis.

The platinum-group metal component may be incorporated into the aromatization catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloro-platinate, bromoplatinic acid, platinum dichloride, platinum tetrachloride hydrate, tetraamine platinum chloride, tetraamine platinum nitrate, platinum dichloro-carbonyl dichloride, dinitrodiaminoplatinum, palladium chloride, palladium chloride dihydrate, palladium nitrate, etc. Chloroplatinic acid or tetraamine platinum chloride are preferred as the source of the preferred platinum component.

It is within the scope of the present invention that the catalyst may contain supplemental metal components known to modify the effect of the preferred platinum component. Such metal modifiers may include Group IVA(14) metals, other Group VIII(8–10) metals, rhenium, indium, gallium, bismuth, zinc, uranium, dysprosium, thallium and mixtures thereof. One or more of rhenium, germanium, tin, lead, gallium, indium and bismuth are preferred modifier metals, with tin and indium being especially preferred. Catalytically effective amounts of such metal modifiers may be incorporated into the catalyst by any means known in the art.

The final olefin-forming catalyst generally will be dried at a temperature of from about 100° to 320° C. for about 0.5 to 24 hours, followed by oxidation at a temperature of about 300° to 650° C. in an air atmosphere which preferably contains a chlorine component for 0.5 to 10 hours. Preferably the oxidized catalyst is subjected to a substantially water-free reduction step at a temperature of about 300° to 650° C. for 0.5 to 10 hours or more. The duration of the reduction step should be only as long as necessary to reduce the platinum-group metal, in order to avoid pre-activation of the catalyst, and may be performed in-situ as part of the plant startup if a dry atmosphere is maintained.

The above catalysts have been found to effect selective dehydrogenation of paraffins and naphthenes in a naphtha feedstock at conditions including temperatures within the range of from about 350° to 650° C. and preferably 450° to 600° C., with higher temperatures being more appropriate for lighter feedstocks. Operating pressures suitably are in excess of about 10 kPa, and preferably range from about 100 kPa to 4 MPa absolute with the optimum range being between about 0.5 and 2 MPa. Hydrogen to hydrocarbon molar ratios relative to the feedstock are in the range of about 0.1 to 100, preferably between about 0.5 and 10. Liquid hourly space velocities (LHSV) range from about 0.1 to 100, and optimally are in the range of about 0.5 to 20.

The olefin-containing intermediate stream comprises the feed to the aromatization zone of the present process combination. Although hydrogen and light hydrocarbons may be removed by flash separation and/or fractionation from the intermediate stream between the olefin-forming zone and the aromatization zone, the intermediate stream preferably is transferred between zones without separation of hydrogen or light hydrocarbons.

Contacting within the olefin-forming and aromatization zones may be effected using the catalyst in a fixed-bed system, a moving-bed system, a fluidized-bed system, or in a batch-type operation. A fixed-bed system is preferred. The reactants may be contacted with the bed of catalyst particles in either upward, downward, or radial-flow fashion. The reactants may be in the liquid phase, a mixed liquid-vapor phase, or a vapor phase when contacting the catalyst bed. The aromatization zone may be in a single reactor or in two or more separate reactors with suitable means therebetween to ensure that the desired aromatization temperature is maintained at the entrance to each zone. Two or more reactors in sequence are preferred to enable improved aromatization through control of individual reactor temperatures and for partial catalyst replacement without a process shutdown. Optimally, the olefin-forming zone is contained in the first reactor of a catalytic reforming unit followed by reactors comprising the aromatization zone.

Conversion of the olefin-containing intermediate stream is effected in an aromatization zone which may comprise two or more fixed-bed reactors in sequence or moving-bed reactors with continuous catalyst regeneration; the process combination of the invention is useful in both embodiments. The reactants may contact the catalyst in upward, downward, or radial-flow fashion, with radial flow being preferred. Aromatization operating conditions include a pressure of from about 100 kPa to 4 MPa (absolute), with the preferred range being from about 100 kPa to 2 MPa and a pressure of below about 1000 kPa being especially preferred. Hydrogen is supplied to the aromatization zone in an amount sufficient to correspond to ratio of from about 0.1 to 10 moles of hydrogen per mole of hydrocarbon feedstock. The operating temperature generally is in the range of 260° to 560° C. The volume of the contained aromatization catalyst corresponds to a liquid hourly space velocity of from about 0.5 to 40 $hr^{-1}$.

The aromatization catalyst conveniently is a dual-function composite containing a metallic hydrogenation-dehydrogenation component on a refractory support which provides acid sites for cracking, isomerization, and cyclization. The hydrogenation-dehydrogenation component comprises a supported platinum-group metal component, with a platinum component being preferred. The platinum may exist within the catalyst as a compound, in chemical combination with one or more other ingredients of the catalytic composite, or as an elemental metal; best results are obtained when substantially all of the platinum exists in the catalytic composite in a reduced state. The catalyst may contain other metal components known to modify the effect of the preferred platinum component, including Group IVA (14) metals, other Group VIII (8–10) metals, rhenium, indium, gallium, zinc, uranium, dysprosium, thallium and mixtures thereof with a tin component being preferred.

The refractory support of the aromatization catalyst should be a porous, adsorptive, high-surface-area material which is uniform in composition. Preferably the support comprises refractory inorganic oxides such as alumina, silica, titania, magnesia, zirconia, chromia, thoria, boria or mixtures thereof, especially alumina with gamma- or eta-alumina being particularly preferred and best results being obtained with "Ziegler alumina" as described hereinbefore and in the references. Optional ingredients are crystalline zeolitic aluminosilicates, either naturally occurring or synthetically prepared sucn as FAU, MEL, MFI, MOR, MTW (IUPAC Commission on Zeolite Nomenclature), and non-zeolitic molecular sieves such as the aluminophosphates of U.S. Pat. No. 4,310,440 or the silico-aluminophosphates of U.S. Pat. No. 4,440,871 (incorporated by reference). Further details of the preparation and activation of embodiments of the above aromatization catalyst are disclosed in U.S. Pat. No. 4,677,094 (Moser et al.), which is incorporated into this specification by reference thereto.

In an advantageous alternative embodiment, the aromatization catalyst comprises a large-pore molecular sieve. The term "large-pore molecular sieve" is defined as a molecular sieve having an effective pore diameter of about 7 angstroms or larger. Examples of large-pore molecular sieves which might be incorporated into the present catalyst include LTL, FAU, AFI, MAZ, and zeolite-beta, with a nonacidic L-zeolite (LTL) being especially preferred. An alkali-metal component, preferably comprising potassium, and a platinum-group metal component, preferably comprising platinum, are essential constituents of the alternative aromatization catalyst. The alkali metal optimally will occupy essentially all of the cationic exchangeable sites of the nonacidic L-zeolite. Further details of the preparation and activation of embodiments of the alternative aromatization catalyst are disclosed, e.g., in U.S. Pat. No. 4,619,906 (Lambert et al) and U.S. Pat. No. 4,822,762 (Ellig et al.), which are incorporated into this specification by reference thereto.

Hydrogen is admixed with or remains with the olefin-containing intermediate stream to the aromatization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mol ratio in the reactor effluent is equal to or less than 0.05, generally obviating the need to recycle hydrogen from the reactor effluent to the feed.

The aromatization zone generally comprises a separation section, usually comprising one or more fractional distillation columns having associated appurtenances and separating lighter components from the aromatics-rich product. In addition, the $C_5$+ aromatics-rich product may be separated into two or more fractions for ease in blending different grades of gasoline or providing a suitable fraction for petrochemical manufacture.

Preferably part or all of the aromatics-rich product is blended into finished gasoline along with other gasoline components from refinery processing including but not limited to one or more of butanes, butenes, pentanes, naphtha, other reformates, isomerate, alkylate, polymer, aromatic extract, heavy aromatics; gasoline from catalytic cracking, hydrocracking, thermal cracking, thermal reforming, steam pyrolysis and coking; oxygenates such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

Example I

A catalyst of the known art designated "A" was prepared in accordance with the teachings of Dessau et al. '529 relating to the first-stage catalyst and had the following composition in mass-%:

| | |
|---|---|
| Platinum | 0.68 |
| Indium | 0.19 |
| Siiica binder | 15 |
| Potassium L-zeolite | balance |

Example II

A nonacidic olefin-forming catalyst suitable for use in the olefin-forming zone of the invention, designated "B", was prepared having the following composition in mass-%:

| | |
|---|---|
| Platinum | 0.37 |
| Tin | 0.29 |
| Lithium | 0.6 |
| Chlorine | 1.4 |
| Gamma alumina | balance |

Example III

The two catalysts were tested for heptane conversion at identical conditions:

| | |
|---|---|
| Pressure | 1 atmosphere |
| $H_2$/n-heptane ratio | 60 molar |
| Space velocity | 1000 cc/min/g catalyst |
| Temperature | 450° C. |

Comparative results for aromatization of n-heptane were as follows for the two catalysts, expressed as mass-% yield of toluene:

| | |
|---|---|
| Catalyst A | 39.1 |
| Catalyst B | 0.5 |

Catalyst A of the known art effected a significantly higher degree of aromatization than Catalyst B of the invention.

Example IV

The feedstock used in Examples V and VI was a full-range naphtha derived from a paraffinic mid-continent crude oil which has the following characteristics:

| | |
|---|---|
| Specific gravity | 0.736 |
| Distillation, ASTM D-86, ° C. | |
| IBP | 83 |
| 10% | 93 |
| 50% | 112 |
| 90% | 136 |
| EP | 160 |
| Mass % | |
| paraffins | 60.4 |
| naphthenes | 26.7 |
| aromatics | 12.9 |

Example V

The benefits of using the process combination of the invention are illustrated by contrasting results with those from a corresponding process of the prior art. This Example IV presents results based on the use of a prior-art process.

The prior art is illustrated by conventional reforming of the naphtha feedstock described above. A pilot plant was loaded with an aromatization catalyst comprising platinum-tin on chlorided spherical alumina particles prepared as described hereinabove. Aromatization of the naphtha feedstock was effected at a pressure of about 800 kPa and a hydrogen-to-hydrocarbon mol ratio of 8. Conversion of paraffins+naphthenes in the feedstock was varied through a temperature survey, with results recorded at inlet temperatures of 502°, 512°, 522° and 532° C.

A profile of $C_5$+ gasoline yield vs. conversion was constructed by plotting multiple yield measurements at each of the above temperature against the con-versions obtained at the respective temperatures. The measurements demonstrated a high degree of repeatability, as shown in the profile of FIG. 1.

Figure 2:
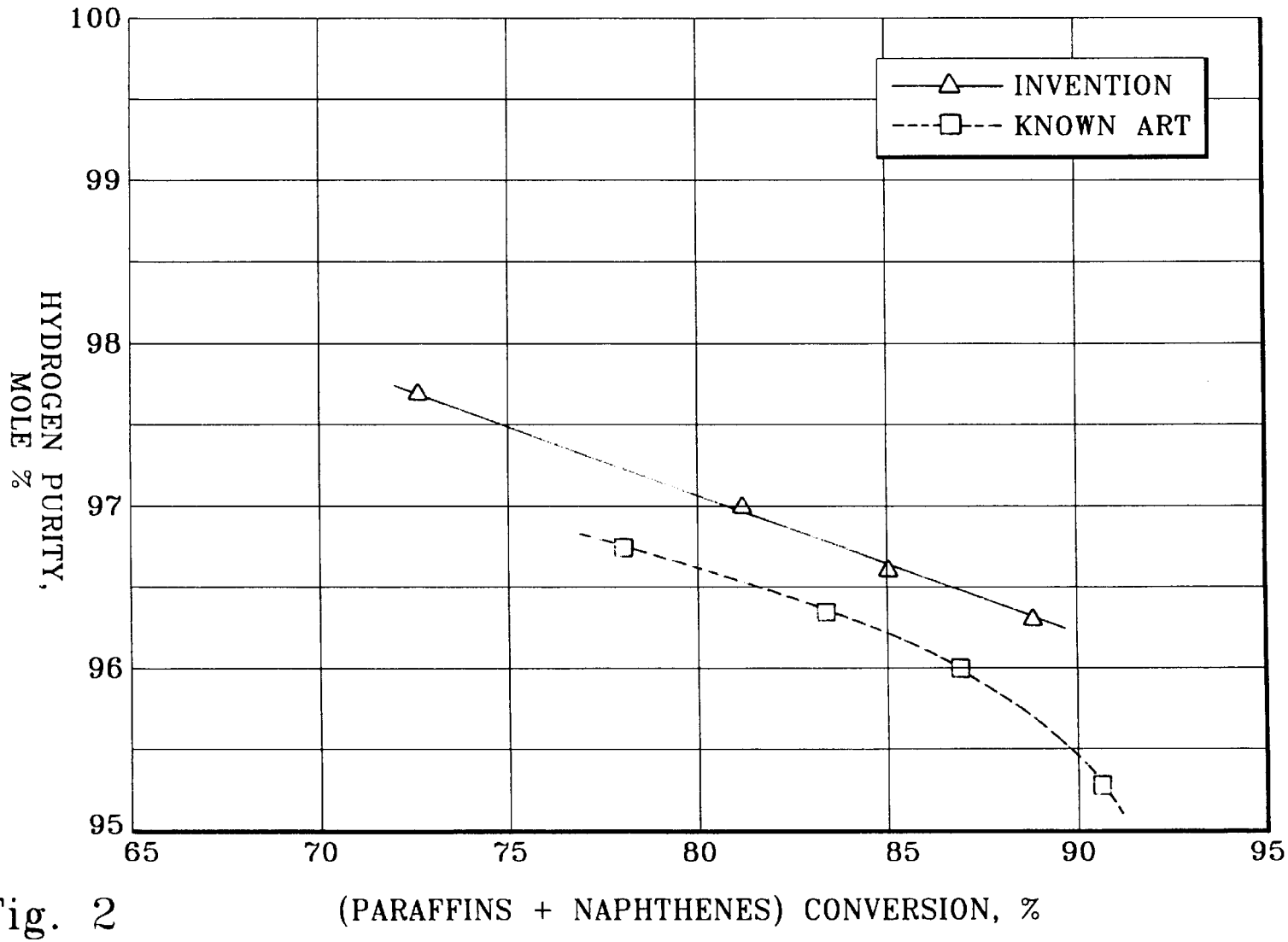
FIG. 2 shows hydrogen purity, as a function of (paraffins+naphthenes) conversion in feed naphtha, in product gas from the process combination of the invention in comparison to conventional reforming.

Hydrogen purity is another indication of $C_5$+ gasoline selectivity, as byproduct gases (methane, ethane, etc.) produced in aromatization will reduce hydrogen purity. FIG. 2 is a profile of hydrogen purity at each of the four temperatures at which results were recorded.

Example VI

Results from applying the process combination of the invention are illustrated in Example V. The process combination of the invention was tested in comparison with the results of the prior-art tests described in Example 1, based on the naphtha feedstock described above.

A pilot plant was loaded with sequential beds of 25 mass % nonacidic olefinforming catalyst and 75 mass % bifunctional aromatization catalyst. The olefin-forming catalyst comprised platinum-tin on alkali-metal-exchanged spherical alumina particles prepared as described hereinabove, and the aromatization catalyst was as described in Example IV. Conversion of the naphtha feedstock was effected at a pressure of about 800 kPa and a hydrogen-to-hydrocarbon mol ratio of 8. Conversion of paraffins+naphthenes in the feedstock was varied through a temperature survey as in Example IV, with results recorded at inlet temperatures of 502°, 512°, 522° and 532° C.

A profile of $C_5$+ gasoline yield vs. conversion was constructed by plotting multiple yield measurements at each of the above temperature against the con-versions obtained at the respective temperatures. FIG. 1 indicates that $C_5$+ yields are improved by 0.5–0.8 mass % relative to the prior-art results.

FIG. 2 compares the profile of hydrogen purity, as another indication of $C_5$+ gasoline selectivity, at each of the four temperatures at which results were recorded. The process of the invention shows about 1% higher hydrogen purity, or 25–30% lower content of light hydrocarbons in hydrogen, than the process of the prior art.

The process combination of the invention thus features improved selectivity, as indicated by higher $C_5$+ yield and lower yield of light hydrocarbons, than the prior-art process.

What is claimed is:

1. A process combination for selectively upgrading a naphtha feedstock to obtain an aromatics-rich product having an increased octane number comprising the steps of:

(a) contacting the naphtha feedstock in an olefin-forming zone with a nonacidic, non-zeolitic olefin-forming catalyst, comprising at least one platinum-group metal component and a nonacidic support, at olefin-forming conditions comprising a temperature of from about 350 to 650° C., pressure of from about 100 kPa to 4 MPa and liquid hourly space velocity of from about 0.1 to 100 $hr^{-1}$ to dehydrogenate paraffins without substantial dehydrocyclization and produce an olefin-containing intermediate stream; and, (b) converting the olefin-containing intermediate stream to yield aromatics in an aromatization zone maintained at aromatization conditions comprising a temperature of from about 260 to 560° C., pressure of from about 100 kPa to 4 MPa and liquid hourly space velocity of from about 0.5 to 40 $hr^{-1}$ in the presence of free hydrogen with a solid acid aromatization catalyst comprising a supported platinum-group metal component and recovering the aromatics-rich product.

2. The process combination of claim 1 wherein the olefin-containing intermediate stream is transferred from the olefin-forming zone to the aromatization zone without separation of hydrogen or light hydrocarbons.

3. The process combination of claim 1 wherein the conversion of alkylcyclopentanes in the olefin-forming zone is less than about 50%.

4. The process combination of claim 3 wherein the conversion of alkylcyclopentanes in the olefin-forming zone is less than about 30%.

5. The process combination of claim 1 wherein the platinum-group metal component of step (a) comprises a platinum component.

6. The process combination of claim 1 wherein the support of step (a) is substantially free of material isostructural with zeolites.

7. The process combination of claim 1 wherein the support of step (a) consists essentially of a nonacidic inorganic oxide.

8. The process combination of claim 7 wherein the inorganic oxide comprises alumina.

9. The process combination of claim 8 wherein the support comprises potassium-exchanged alumina.

10. The process combination of claim 1 wherein the support of step (a) comprises a metal-oxide solid solution.

11. The process combination of claim 1 wherein the olefin-forming catalyst comprises a metal modifier selected from one or more of the group consisting of rhenium, germanium, tin, lead, gallium, indium and bismuth.

12. The process combination of claim 1 wherein the platinum-group metal component of step (b) comprises a platinum component.

13. The process combination of claim 1 wherein the support of step (b) comprises alumina.

14. The process combination of claim 1 further comprising blending at least a portion of the aromatics-rich product into finished gasoline.

15. A process combination for selectively upgrading a naphtha feedstock to obtain an aromatics-rich product having an increased octane number comprising the steps of:

(a) contacting the naphtha feedstock in an olefin-forming zone with a nonacidic, non-zeolitic olefin-forming catalyst, comprising at least one platinum-group metal component and a support consisting essentially of a non-acidic inorganic-oxide, at olefin-forming conditions comprising a temperature of from about 350 to 650° C., pressure of from about 100 kPa to 4 MPa and liquid hourly space velocity of from about 0.1 to 100 $hr^{-1}$ to dehydrogenate paraffins without substantial dehydrocyclization and produce an olefin-containing intermediate stream; and, (b) converting the olefin-containing intermediate stream from the olefin-forming zone without separation of hydrogen to yield aromatics in an aromatization zone maintained at aromatization conditions comprising a temperature of from about 260 to 560° C., pressure of from about 100 kPa to 4 MPa and liquid hourly space velocity of from about 0.5 to 40 $hr^{-1}$ with a solid acid aromatization catalyst comprising at least one platinum-group metal component and recovering the aromatics-rich product.

16. A process combination for selectively upgrading a naphtha feedstock to obtain an aromatics-rich product having an increased octane number comprising the stews of:

(a) contacting the naphtha feedstock in an olefin-forming zone with a nonacidic, non-zeolitic olefin-forming catalyst, comprising at least one platinum-group metal component and a support consisting essentially of a metal-oxide solid solution, at olefin-forming conditions comprising a temperature of from about 350 to 650° C., pressure of from about 100 kPa to 4 MPa and liquid hourly space velocity of from about 0.1 to 100 $hr^{-1}$ to dehydrogenate paraffins without substantial dehydrocyclization and produce an olefin-containing intermediate stream; and, (b) converting the olefin-containing intermediate stream from the olefin-forming zone without separation of hydrogen to yield aromatics in an aromatization zone maintained at aromatization conditions comprising a temperature of from about 260 to 560° C., pressure of from about 100 kPa to 4 MPa and liquid hourly space velocity of from about 0.5 to 40 $hr^{-1}$ with a solid acid aromatization catalyst comprising at least one platinum-group metal component and recovering the aromatics-rich product.

* * * * *